US005211704A

United States Patent [19]

Mansour

[11] Patent Number: 5,211,704

[45] Date of Patent: May 18, 1993

[54] PROCESS AND APPARATUS FOR HEATING FLUIDS EMPLOYING A PULSE COMBUSTOR

[75] Inventor: Momtaz N. Mansour, Columbia, Md.

[73] Assignee: Manufacturing Technology and Conversion International, Inc., Columbia, Md.

[21] Appl. No.: 729,721

[22] Filed: Jul. 15, 1991

[51] Int. Cl.[5] ..... F23C 1/04

[52] U.S. Cl. ..... 431/2; 431/1; 122/24; 110/213

[58] Field of Search ..... 110/203, 212, 213; 122/24; 431/1, 2

[56] References Cited

U.S. PATENT DOCUMENTS

| | | | |
|---|---|---|---|
| 2,539,466 | 1/1951 | Parry . | |
| 2,619,415 | 11/1952 | Hemminger . | |
| 2,623,815 | 12/1952 | Roetheli et al. . | |
| 2,680,065 | 6/1954 | Atwell . | |
| 2,683,657 | 7/1954 | Garbo . | |
| 2,722,180 | 11/1955 | McIlvaine | 122/24 |
| 2,937,500 | 5/1960 | Bodine, Jr. . | |
| 2,979,390 | 4/1961 | Garbo . | |
| 3,246,842 | 4/1966 | Huber . | |
| 3,333,619 | 8/1967 | Denis . | |
| 3,606,867 | 9/1971 | Briffa . | |
| 3,966,634 | 6/1976 | Sacks . | |
| 4,260,361 | 4/1981 | Huber . | |
| 4,368,677 | 1/1983 | Kline . | |
| 4,529,377 | 7/1985 | Zinn et al. . | |
| 4,655,146 | 4/1987 | Lemelson . | |
| 4,682,985 | 7/1987 | Kohl . | |
| 4,699,588 | 10/1987 | Zinn et al. . | |
| 4,708,159 | 11/1987 | Lockwood, Jr. . | |
| 4,773,918 | 9/1988 | Kohl . | |
| 4,819,873 | 4/1989 | Lockwood, Jr. | 431/1 |
| 4,846,149 | 7/1989 | Chato . | |
| 4,909,731 | 3/1990 | Zinn et al. . | |
| 4,940,405 | 7/1990 | Kelly | 122/24 |
| 4,951,613 | 8/1990 | Harandi et al. . | |
| 4,959,009 | 9/1990 | Hemsath | 122/24 |
| 4,992,039 | 2/1991 | Lockwood, Jr. | 431/1 |
| 5,015,171 | 5/1991 | Zinn et al. | 431/1 |

FOREIGN PATENT DOCUMENTS

| | | |
|---|---|---|
| 3109685 | 9/1982 | Fed. Rep. of Germany . |
| 2301633 | 9/1976 | France . |
| 8200047 | 1/1982 | PCT Int'l Appl. . |
| 644013 | 10/1950 | United Kingdom . |
| 665728 | 1/1952 | United Kingdom . |
| 1544446 | 4/1979 | United Kingdom . |

OTHER PUBLICATIONS

Patent Abstracts of Japan, JP1080437, Mar. 27, 1989.
Soviet Inventions Illustrated, SU879-146 Feb. 29, 1980.

*Primary Examiner*—A. Michael Chambers
*Attorney, Agent, or Firm*—Dority & Manning

[57] ABSTRACT

Improved fluid heating apparatus and process, exemplified by steam boilers in which a pulse combustor serves to produce a heat source for enhanced steam generation, particularly in commercial or industrial applications are provided. The system may be slagging or non-slagging as needed and may employ a means for collecting and removing contaminants and particulates entrained in the combustion product stream.

20 Claims, 8 Drawing Sheets

PROCESS AND APPARATUS FOR HEATING FLUIDS EMPLOYING A PULSE COMBUSTOR

FIELD OF THE INVENTION

This invention relates to apparatus and processes for treating fluids such as gases, water and other liquids with heat using a pulse combustor.

BACKGROUND OF THE INVENTION

Based on studies which indicated a large potential for significantly increased coal-firing in the commercial sector, the development of advanced coal combustion systems is currently being pursued.

Fluid heating systems known in the art include conventional combustion systems in communication with boiler assemblies. Oil or gas is primarily used in these conventional combustion systems to provide heat to water passing through boiler systems. The heated water or steam is then forwarded for its desired application, such as space heating, turbine operation, or otherwise.

Conventional oil and gas systems suffer from a major drawback—availability and price stability, both of which are subject to the turbulent conditions in the Middle East. Solid domestic fuels, on the other hand, are generally plentiful at the present time and are not faced with the same concerns.

A major concern, however, with utilizing solid fuels such as coal, particularly the cheaper low grade sulfur-containing coals, for supplying heat to conventional fluid heating devices such as a fire tube boiler, is the amount of particulates and other contaminants produced by combustion that are carried over in the combustion gas stream. A particulate-contaminant-laden gas stream operating such systems can adversely impact the atmosphere as such particulate is released thereto. Although conventional devices such as cyclones may be used to remove larger particulate matter from combustion gas streams, these devices generally fail to remove smaller particulates such as fly ash from the streams. Similar problems also exist in other gas streams in which the suspended particulate matter originates from other than combustion.

Fuel-bound nitrogen also causes nitrogen oxide ($NO_x$) emissions to form in the gas stream. Methods and processes to either reduce the production of nitrogen oxides or to destroy or remove such pollutants from the flue gas stream are necessary to meet the requirements of the Clean Air Act. Economically viable means for removing these pollutants from the exhaust stream before discharging such exhaust into the atmosphere have not heretofore been available.

Various attempts have been made to overcome the above and other problems and to provide an economically feasible and efficient process for treating fluids using a solid fuel. One such attempt has focused on ultracleaning the coal prior to combustion to reduce coal-based contaminants. The coal must be extensively cleaned in an attempt to remove ash and sulfur from the fuel prior to firing. Generally, a cold water slurry is made from micronized, deeply cleaned coal and then used as fuel. This approach is very expensive and imposes delays in time before the coal may be used. It does, however, produce an essentially oil-like slurry fuel made from coal.

In summary, effective reduction of suspended particulates and other contaminants in a gas stream created by combustion remains a paramount problem due to the lack of a cost effective, efficient system for particulate and contaminant removal. Available particulate collection/removal systems are limited by combustor operating conditions. Any new systems should possess a number of attributes, such as high combustion efficiency, high sulfur capture capability, high solid fuel particulate removal, low nitrogen oxide emissions, and high removal of alkali vapors created by the combustion of the fuel. New systems providing these attributes should be relatively inexpensive and should not require substantial preparation and pre-cleaning of the fuel used for combustion.

Acoustic agglomeration is a process in which high intensity sound is used to agglomerate submicron- and micron-sized particles in aerosols. This concept is a pretreatment process to increase the average size of entrained particulates to permit high collection/removal efficiencies using cyclone or other conventional separators. Sound waves cause relative motion between the solid particles, and hence, increase their collision frequency. Once the particles collide, they are likely to stick together. As an overall result of sound treatment, the particle size distribution in the aerosol shifts significantly from small to larger sizes relatively quickly. Larger particles may be more effectively filtered from the carrying gas stream by conventional particulate removal devices such as cyclones. The combination of an acoustic agglomeration chamber with one or more cyclones in series provides a promising high-efficiency system to clean particulate-laden gases such as hot flue gases from pressurized combustors.

Acoustic agglomeration of small particles in hot combustion gases and other sources of fine dust-bearing effluent streams has been studied intermittently for many years. Although effective in producing larger-sized particles (5 to 20 microns) for more efficient removal by conventional devices, the prior art methods of acoustic agglomeration are not generally viewed as potential clean-up devices due to their large power requirements. For example, fine fly ash particulates (less than 5 microns in size) have been agglomerated using high-intensity acoustic fields at high frequencies in the 1,000–4,000 Hz range. These higher frequencies were necessary for the disentrainment of the fine particulate so as to effect collisions therebetween, and hence, agglomeration of the fine particles.

In these prior art acoustic agglomeration devices, the acoustic fields have been produced by sirens, air horns, or electromagnetic speakers. The resulting acoustic generation for sonic agglomeration requires power estimated to be in the range of 0.5 to 2 hp/1,000 cfm. This, of course, is a significant parasitic power loss even for efficient horns and sirens which normally have efficiencies ranging from 8 to 10%.

Furthermore, the sirens and air horns require auxiliary compressors to pressurize air. Electromagnetic devices require special designs and precautions to provide the desired equipment reliability, availability and life. In addition, powerful amplifiers are required to drive such speakers to deliver 160 decibels (dB) or more of sound pressure.

In addition to the foregoing, desired system performance goals include dual fuel capability (i.e., coal as primary fuel and a premium fuel as secondary fuel), combustion efficiency exceeding 99 percent, thermal efficiency greater than 80 percent, turndown of at least 3:1, dust-free and semi-automatic dry ash removal, fully automatic start-up with system purge and ignition verification, emissions performance exceeding new source performance standards and approaching those produced by fuel oil-fired commercial-scale units, and reliability, safety, operability, maintainability, and service life comparable to the oil-fired units currently employed for heating fluids.

The apparatus and process according to the present invention overcome most, if not all, of the above-noted problems of the prior art and generally possess the desired attributes set forth above by using a pulse combustor to produce a heat source for enhancing the generation of fluid heat, such as the creation of steam. The present invention may be designed to operate in both a slagging and a non-slagging mode.

SUMMARY OF THE INVENTION

It is thus an object of the present invention to provide an improved fluid heating apparatus and process.

Another object of the present invention is to provide an improved combustor that operates on high sulfur fuel such as coals, while providing for enhanced heat source production and simultaneous, efficient clean-up of particulates produced by the burning of such fuels.

Still another object according to the present invention is to provide a high efficiency pulse combustor system to heat a fluid.

It is yet another object of the present invention to provide a means for removing unwanted contaminants from the hot gaseous stream created by the high efficiency pulse combustor.

Another object of the present invention is to provide for contaminant capture and removal of particulate combustion products entrained within a gas stream.

Another object according to the present invention is to provide a pulse combustor for producing a heat source for enhanced steam generation.

A further object according to the present invention is to provide a slagging pulse combustion system for improved heating of fluids.

Yet another object of the present invention is to provide a non-slagging pulse combustion system for improved heating of fluids.

It is yet another object of the present invention to provide a fluid heating apparatus that enhances particulate removal from a gas stream used to heat fluids.

Generally speaking, apparatus according to the present invention includes a fluid treating vessel having means for containing a fluid to be heated and further having means for allowing the passage of hot gases therethrough to effectuate heat transfer from the gas passing therethrough to the fluid to be heated, pulse combustion means in communication with the hot gas passage means of the fluid treating vessel wherein the pulse combustion means are capable of combusting a fuel-air mixture to produce a pulsating flow of hot combustion products and an acoustic wave having a frequency and a range of from about 20 to about 1500 Hz, means located along an initial portion of the hot gas passage means so that particulate in the gas stream passing through the hot gas passage means may be partially removed, and means for substantially removing the remaining particulate from the gas passing through the hot gas passage means.

Generally speaking, the process according to the present invention includes the steps of passing a fluid to be heated through a vessel, pulse combusting a fuel to produce a pulsating flow of combustion products and an acoustic pressure wave having a frequency of from about 20 to about 1500 Hz, passing the flow of combustion products created by the pulse combusting through the vessel containing the fluid to be heated so that heat is transferred to the fluid, and removing particulate materials from the combustion product flow.

BRIEF DESCRIPTION OF THE FIGURES

The construction designed to carry out the invention will be hereinafter described, together with other features thereof. The invention will be more readily understood from reading of the following specification and by reference to the accompanying drawings forming a part thereof, wherein an example of the invention is shown and wherein.

DESCRIPTION OF THE PREFERRED EMBODIMENTS

Figure 1:
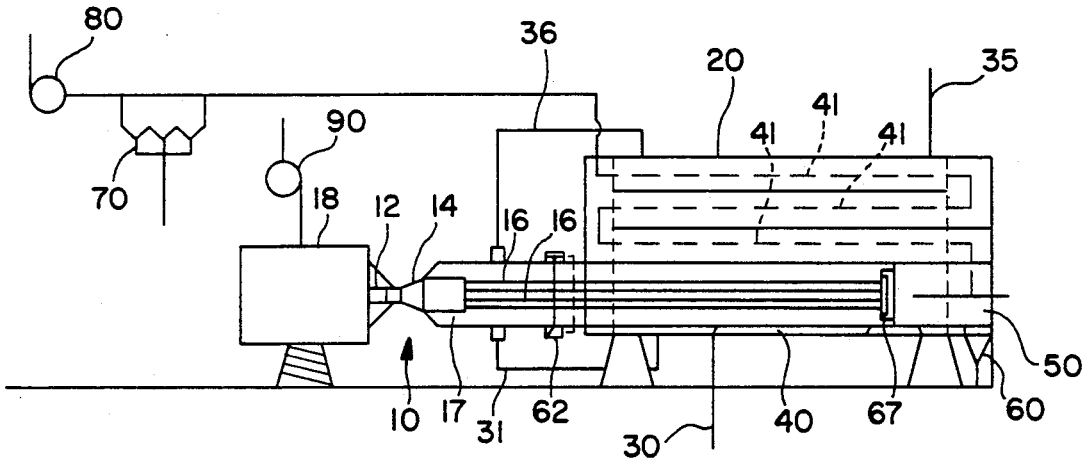
FIG. 1 is a schematic of a pulse combusted boiler tube arrangement for heating fluids according to the present invention.

The preferred apparatus for heating a fluid according to the present invention integrates a pulse combustor means with a fluid treating vessel having means for containing a fluid to be heated and allowing entrance and exit of the fluid therefrom. The fluid treating vessel further has means to allow for the passage of hot gases therethrough that have been are produced by a pulse combustion means, with the gases being in a heat exchange relationship with the fluid to be heated. The apparatus further includes a means for removing particulate entrained in the combustion products flow created by the pulse combustor and may additionally employ an advanced pulse combustion chamber design and valve means. The pulse combustor system according to the present invention is especially useful for burning a solid fuel such as a low grade coal.

Advanced coal-fired combustors generally use coal prepared in one of the following forms: dry pulverized coal, dry ultrafine coal, coal-water mixture. Dry pulverized coal is conventional ground coal that typically has a product fineness of 70% through a 200-mesh sieve and less than 3% surface moisture. This is the cheapest of the three forms. Dry ultrafine coal is a product of an integrated process comprising grinding, drying and beneficiation. Ultrafine coal is thus a fine powder with low ash and sulfur content and is more expensive than dry pulverized coal. Coal-water mixture refers to a mixture of pulverized coal and water with certain chemicals added to enhance stability and flow characteristics. A coal-water mixture fuel is cheaper and safer to transport and store than dry pulverized coal and dry ultrafine coal. The availability of coal-water mixture fuels is, however, rather limited.

Pulse combustors according to the present invention can burn all types of coal efficiently (greater than 99% carbon conversion) and without gas support. Dry pulverized coal, however, is more economical to burn and boasts a more mature technology and infrastructure as compared to dry ultrafine coal. The high combustion intensity and the acoustic wave achieved in the pulse combustion of the present invention permits the use of pulverized rather than ultrafine coal without any performance penalty. Further, according to the present invention sulfur and particulate are easily removable from the combustion product stream wherefore the cheaper, unbeneficiated coal may be advantageously employed.

When unbeneficiated coals are used to fire the pulse combustion system of the present invention, contained sulfur must be removed to meet emissions requirements. Sorbents for produced sulfur derivatives may be injected into the system for this purpose. Exemplary sorbents for sulfur derivatives include limestone, lime, hydrated lime, and dolomite. A particularly preferred sorbent for the present application is Gen-Star limestone with a calcium carbonate content of about 89% by weight.

The present invention is particularly useful for heating water to generate steam. The ability of steam to give off heat, promote its own circulation, and permit ease of distribution and control in a heating system are equally advantageous. Besides, a significant number of steam-heat installations already exist throughout the world representing a large retrofit market, though many of such systems are fired by petroleum-based fuels which are subject to significant price instability and availability as explained above. It should be appreciated, however, that other fluids such as gases and other liquids may be heated by the apparatus disclosed herein.

One apparatus of the present invention having combustion, heat recovery, and emissions control systems is shown in FIG. 1. This embodiment integrates a pulse combustor with a heat recovery system through a main fire tube to a conventional Scotch boiler 20. This particular embodiment is shown operating in a non-slagging mode. A non-slagging mode is achieved by maintaining the temperature of the system below the point at which the particulate formed during combustion and the sorbents, if any, added to the combustion products stream begin to slag (become molten). Of course, in a non-slagging arrangement, solid particles must be removed from the hot gas stream.

In FIG. 1, boiler 20 is in communication with a pulse combustion means generally 10. Boiler 20 includes a main fire tube 40 (Morrison tube) and a number of boiler tube conduits 41 for circulation of the hot gases for heating. Although a four pass fire tube boiler is illustrated, a water tube boiler could also be used with obvious modification. Fluid to be heated enters boiler 20 through a fluid inlet means 30, with steam exiting through fluid outlet means 35. Fluid inlet and outlet means 30 and 35 may be any type of conventional couplings which allow fluids to enter or exit a pressurized container. In the arrangement described herein, fluid inlet means 30 allows water to enter the fluid treating vessel and fluid outlet means 35 allows steam to exit. Additionally, as shown, water may exit vessel 20 feeding a water jacket 17 around a portion of pulse combustor means 10 through line 31, with steam exiting jacket 17 and being routed to boiler 20 via line 36.

Pulse combustor means 10 includes a valve means 12 which may be an aerodynamic valve (fluidic diode), a mechanical valve or the like, a combustion chamber 14 and one or more tailpipes or resonance tubes 16. Additionally, pulse combustor means 10 may include an air plenum 18 and a thrust augmenter (not shown).

Figure 2:
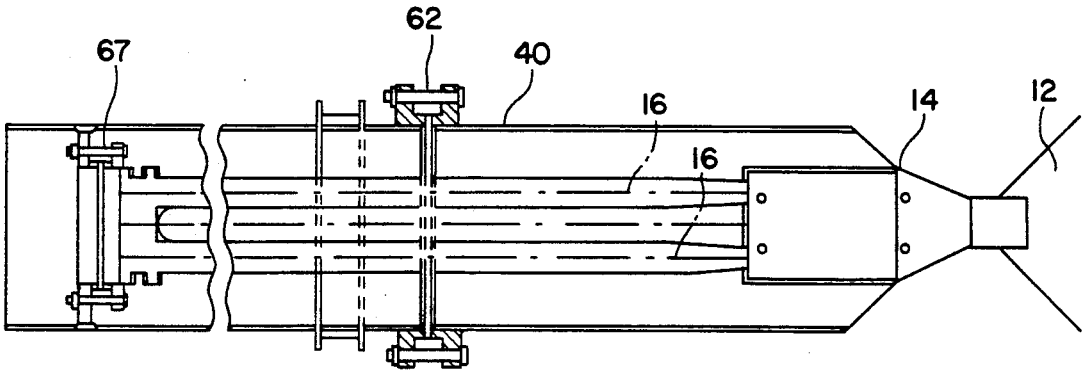
FIG. 2 is a more detailed schematic view of the pulse combustor means of FIG. 1.

Pulse combustor means 10 of FIG. 1 is more readily seen in FIG. 2, wherein like numerals represent like members. In FIG. 2, a plurality of resonance tubes 16 extend into main fire tube (or Morrison tube) 40. Water may be contained within the shell of main fire tube 40 in a conventional fashion. The pulse combustor unit shown in FIG. 2 additionally may employ flanges 62 and expansion joints 67 as necessary for connection to boiler 20.

Figure 4:
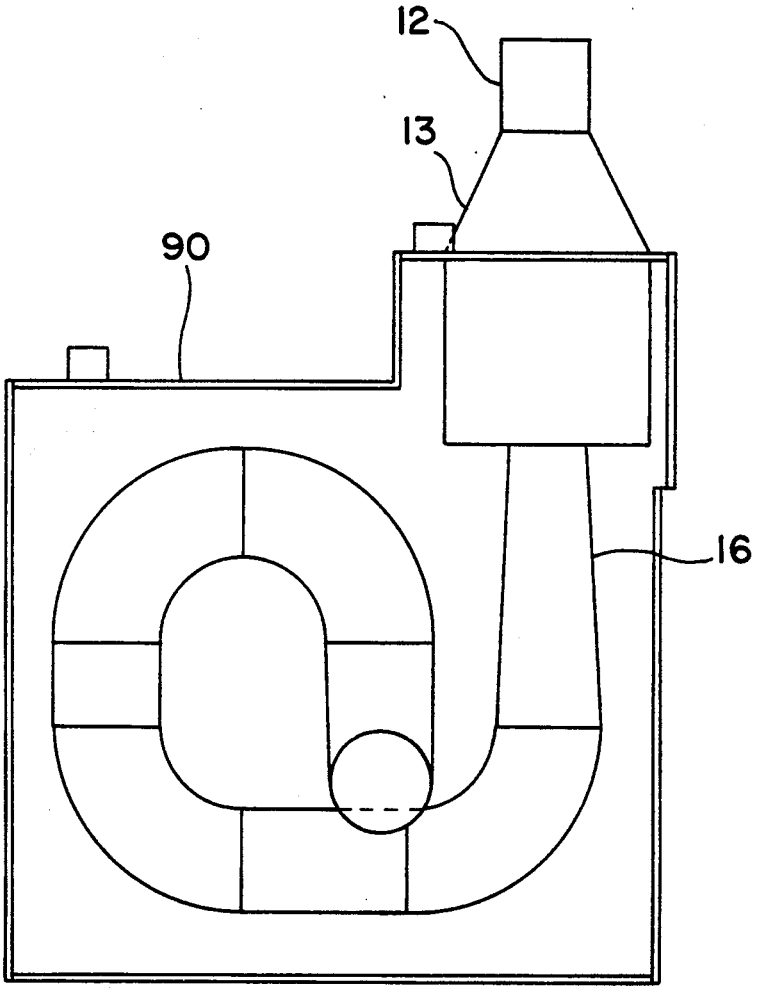
FIG. 4 is a schematic illustration of a compact pulse combustor arrangement according to the present invention.

Resonance tubes 16 may employ a number of different designs. For example, the tube may flare continuously outwardly (shown in the embodiment of FIG. 8) allowing the entire resonance tube 16 to act as a diffuser. Such diffusion reduces gas exit velocity from combustion chamber 14 and provides for recirculation of combustion products and increased particulate residence time within pulse combustor means 10. A compact pulse combustor design employing a spiral-shaped resonance tube 16 is shown in FIG. 4. In this embodiment, resonance tube 16 is surrounded by a water jacket 90 so that steam created by the heat in resonance tube 16 may be removed from the system and directed to a boiler or other heated fluid device. In a further design, resonance tube 16 may be essentially straight as in FIG. 1, but have at its outer end a diffuser section that consists of an outwardly flaring tailpipe section. Alternatively, resonance tube 16 may integrate a diffuser section at the end nearest combustion chamber 14 with an essentially straight tube extending therefrom (shown in FIG. 12).

When operated as described hereinbelow, pulse combustor means 10 produces a pulsating flow of hot combustion products an acoustic wave having a frequency in a range of from about 20 to about 1500 Hz. As fuel is combusted, a pulsating flow of hot combustion products exits combustion chamber 14 and passes into resonance tubes 16 of pulse combustor means 10 and chamber 14, and tubes 16 may or may not be water jacketed as the system dictates. As shown in FIG. 1, the end of Morrison tube 40 opposite pulse combustor means 10 acts as a decoupler section 50 where the hot combustion products stream exits resonance tubes 16 and begins passage through the arrangement of conduits 41 of boiler 20.

An ash drop-out chute 60 or other means may also be provided for removing a portion of the particulate within the gaseous combustion product stream. Location of chute 60 in decoupler section 50 of Morrison tube 40 removes significant particulate from the gas stream prior to gas passage through the rest of boiler 20. An impact or inertial solid separator is one of the alternative means that may be used to effect partial removal of particulate from the gas stream. The hot combustion product stream exits resonance tube 16 at decoupler section 50 and then enters into conduit 41 to begin its passage through boiler 20. Prior to entering conduit 41, a portion of the larger particles entrained within the combustion product stream tend to separate from the gaseous stream. These particulates may then be collected and removed through ash drop-out chute 60 as the gas stream makes its first turn within the hot gas passage means. These larger particles include acoustically agglomerated dry ash and spent sorbent which may be entrained in the gaseous stream. The residual particulate matter in the gaseous stream remains essentially entrained within the gaseous stream during its pass through boiler conduits 41.

As previously explained, pulse combustion means 10 may operate at a temperature below the slagging point of the particulates contained within the gas stream so that solids remain suspended. When operated in a non-slagging dry ash rejection mode, the need for a refractory-lining for combustion chamber 14 and resonance tubes 16 is eliminated, but a multiple resonance tube arrangement employing four (4) or more tailpipes may become necessary.

A further benefit of operating in a non-slagging mode is the potential for reduced nitrogen oxide emissions and improved sulfur capture. Lower temperatures enhance the control of both of these contaminants. Additionally, multiple air staging may be employed for further controlling nitrogen oxide emissions. The incorporation of multiple air staging with near stoichiometric or substoichiometric combustion in combustion chamber 14 and tailpipe 16 by secondary air addition into decoupler section 50 also lowers nitrogen oxide emissions.

Boiler conduits 41 may be arranged within boiler 20 in a conventional serpentine-like pattern within the fluid to be heated. As the hot gas stream passes through boiler 20, heat is transferred to the fluid surrounding conduits 41. As previously mentioned, however, a water tube boiler may also be employed with fluid to be heated is circulated through conduit and with the hot gases surrounding same. The heated fluid may be supplied to other applications such as space heating.

After exiting boiler 20, the hot gases are fed to a further means for removing a substantial portion of the remaining particulate material entrained therein. Conventional particulate collection/removal means for this purpose are denoted in FIG. 1 at 70. Such conventional systems include one or more cyclones or other solids separator. From cyclone 70, the gas is allowed to escape to the atmosphere through a flue gas exhaust. Collected fly ash and other particulate matter, including sorbent that may have been injected into the system for sorption of contaminants, is removed through separator 70.

An induced draft fan 80 may be placed along the hot gas passage means and adjusted to preferably maintain zero gauge static pressure within decoupler section 50. Additionally, a forced draft fan 90 may be employed for supplying primary air to air plenum 18. Air plenum 18 operates as a capacitor and seeks to provide primary air to the pulse combustion means 10 at approximately constant static pressure. The pressure boost developed due to pulse combustion within the present apparatus also reduces the size, power requirements, and cost of forced draft fan 90 and induced draft fan 80.

As previously mentioned, a sorbent such as hydrated lime, lime, limestone, or dolomite may be injected into pulse combustor means 10, or anywhere along the hot gas passage means when operated in a non-slagging mode, to effect sorption of contaminants present in the hot gaseous stream. Particularly, the above-noted sorbents are useful in removing sulfur derivatives such as sulfur dioxide from the gas stream.

Alternatively, or in addition to the sorbent injection means, a means may be provided for injecting a particulate having a size different than the size of the particulate entrained within the combustion product stream.

Bimodal agglomeration occurs as explained above whereby particulates of differing sizes are agglomerated with acoustic enhancement being provided by pulse combustor means 10. Pulse combustor means 10 produces an intense acoustic wave by combustion-induced pressure oscillations when fired with a fuel. The acoustic field produced by combustion resonates through resonance tubes 16 acting directly on the gaseous stream carrying the particulates to effectuate acoustically-enhanced bimodal agglomeration of the particulates in the gaseous stream. Because the agglomerates are larger in size, enhanced removal of the agglomerated particulate is permitted either at the first turn of the hot gas passage means by ash drop-out chute 60 or at the downstream location of removal means 70.

The particulate used to enhance acoustic agglomeration and/or capture contaminants is preferably introduced into the system near the junction of pulse combustion chamber 14 and resonance tubes 16. The interface between resonance tubes 16 and combustion chamber 14 is a region of high heat release and high heat transfer. The high heat provides for a rapid rate of sorbent calcination, further providing for high porosity in the calcined sorbent which, in turn, generates high surface-to-mass ratio without the need for micronization of the sorbent. This, together with the effects of the oscillating flow field, enhances sorbent utilization at relatively low calcium-to-sulfur molar ratios on the order of about 2.5.

The design of the present apparatus may operate at low pressures (less than 30 psig and, preferably, about 15 psig), for saturated steam generation. The boiler shell utilized in the present invention may be one designed initially for oil and gas fire. Furthermore, the apparatus disclosed herein has space requirements similar to those for oil- and gas-fired boilers.

Other attempts to create a clean combustion gas stream have utilized a slagging combustor concept for the removal of the bulk ash particulate. The coal combustors operate at sufficiently high temperature by controlling the stoichiometry of the combustion air to near stoichiometric, in an adiabatic combustion chamber, so that ash becomes molten and is removed in the form of slag from the flue gas.

The high temperatures at which the slagging combustors must operate tend to increase the amount of nitrogen oxides produced in the combustion process. This, in turn, generally requires other means downstream from the coal combustor to reduce the concentration of nitrogen oxides in the effluent gas stream. The high combustion temperatures in the slagging combustors are also inappropriate for sulfur sorbent introduction at pulse combustor 10, for when added, the sorbents also slag, thus destroying their capability to effect sorption of contaminants.

Pulse combustor means 10 may be designed for dual-fuel capacity. The primary fuel may be coal and the secondary fuel natural gas. The secondary fuel not only enables rapid start-up of the unit but also provides back-up in case of disruption in primary fuel supply.

A pulse combustor, such as that employed in the present invention, typically operates in the following manner. Fuel and air enter into combustion chamber 14 and an emission source detonates the explosive mixture during start-up. The sudden increase in volume, triggered by the rapid increase in temperature and evolution of combustion products, pressurizes chamber 14. As the hot gas expands, the valve means 12, preferably a fluidic diode, permits preferential flow in the direction of resonance tube 16. The gaseous combustion products stream exiting combustion chamber 14 and resonance tube 16 possesses significant momentum. A vacuum is created in combustion chamber 14 due to the inertia of the gases within resonance tube 16. The inertia of gases in resonance tube 16 permit only a small fraction of exhaust gases to return to combustion chamber 14, with the balance of the gas exiting through resonance tube 16. Because the chamber pressure is then below atmospheric pressure, air and fuel mixtures are drawn into chamber 14 where auto-ignition takes place. Again, valve means 16 constrains reverse flow, and the cycle begins anew. Once the first cycle is initiated, engine operation is thereafter self-sustained.

The valve means utilized in many pulse combustion systems is a mechanical "flapper valve". The flapper valve is actually a check valve permitting flow from inlet to the combustion chamber, and constraining reverse flow by a mechanical seating arrangement. Although such a mechanical valve may be used in conjunction with the present system, an aerodynamic valve without moving parts is preferred. With an aerodynamic valve, during the exhaust stroke, a boundary layer builds in the valve and turbulent eddies choke off much of the reverse flow. Moreover, the exhaust gases are of a much higher temperature than the inlet gases. Accordingly, the viscosity of the gas is much higher and the reverse resistance of the inlet diameter, in turn, is much higher than that for forward flow through the same opening. These phenomena, along with the high inertia of the exhausting gases in resonance tube 16, combine to yield preferential and mean flow from inlet to exhaust. Thus, pulse combustion creates a self-aspirating engine, drawing its own air and fuel into combustion chamber 14 and auto-igniting combustion products.

The preferred pulse combustor used herein for coal-firing is based on a Helmholtz configuration with an aerodynamic valve. The pressure fluctuations, which are combustion-induced in the Helmholtz resonator-shaped combustor, coupled with the fluidic diodicity of the aerodynamic valve, causes a bias flow of air and combustion products from the combustor's inlet to the exit of resonance tube 16. This results in the combustion air being self-aspirated by the combustor and for an average pressure boost to develop in the combustion chamber to expel the products of combustion at a high average flow velocity (over 1,000 feet/second) through resonance tube 16.

The production of an intense acoustic wave is an inherent characteristic of pulse combustion. Sound intensity adjacent to the wall of pulse combustion chamber 14 is often in the range of 110–190 dB, which may be altered depending on the desired acoustic field frequency to accommodate the specific application undertaken by the pulse combustor.

The rapid pressure oscillation through combustion chamber 14 generates the intense oscillating flow field. In the case of coal combustion, the fluctuating flow field causes the products of combustion to be swept away from the reacting solid coal thus providing access to oxygen with little or no diffusion limitation. Secondly, pulse combustors experience very high mass transfer and heat transfer rates within the combustion zone. While these combustors tend to have very high heat release rates, (typically ten times those of conventional burners), the vigorous mass transfer and high heat transfer within the combustion region result in a more uniform temperature. Thus, peak temperatures attained are much lower than in the case of conventional systems. This results in a significant reduction in nitrogen oxides ($NO_x$) formation as previously noted. The high heat release rates also result in a smaller required combustor size for a given firing rate and a reduction in the required resonance time.

Figure 5:
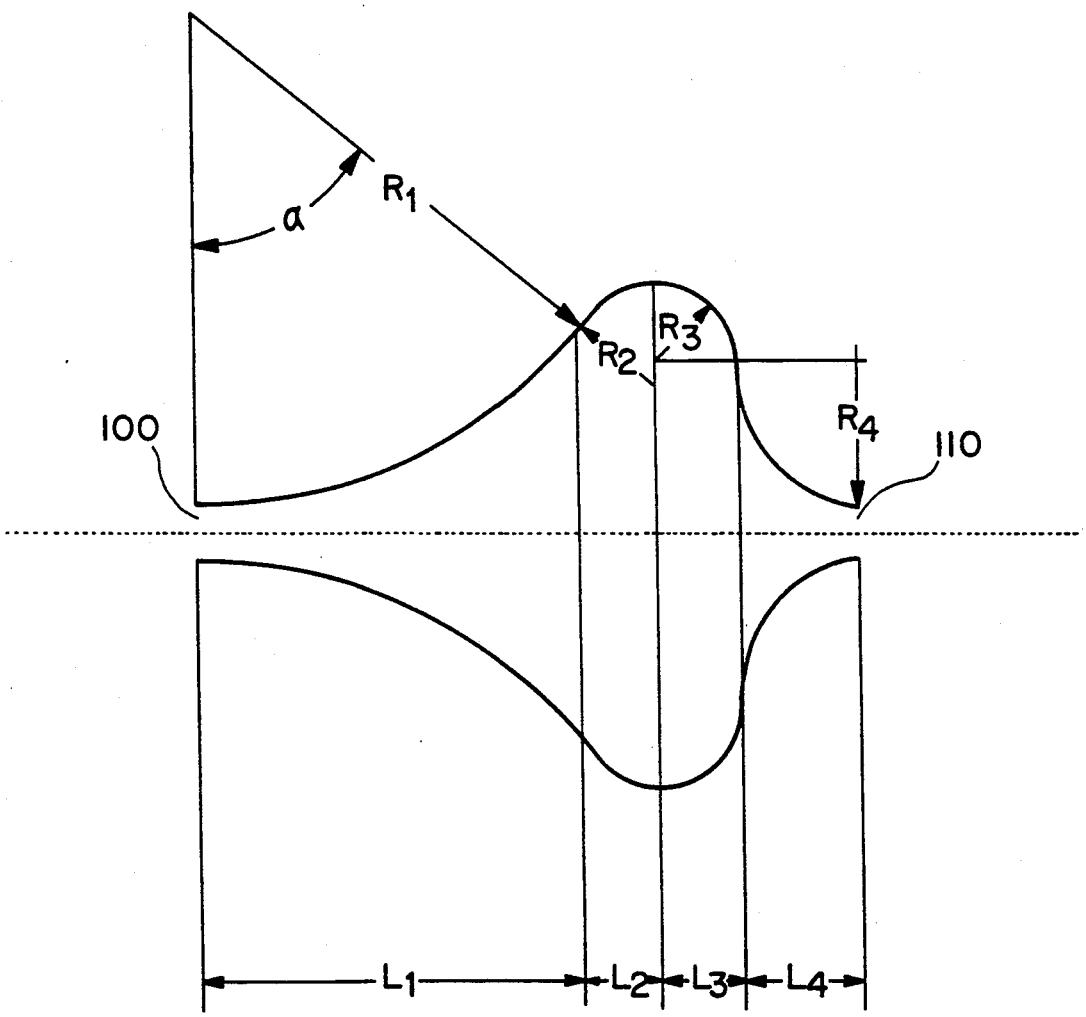
FIG. 5 is an illustration of an embodiment of a preferred pulse combustion chamber according to the present invention.

In certain particular embodiments of the present invention, a pulse combustion chamber design of the type shown in FIG. 5 is preferred. This design employs quadratic form generators to define an axisymmetric geometry that would be alike to accommodate a number of design and chamber performance attributes.

Alphanumeric legends on the pulse combustor illustrated in FIG. 5 correspond to following dimensions which relate to a slagging combustor design (as described hereinafter) having a heat output of 7.5 MMBtu/hr and may be used for determining other pulse combustor designs. Inlet port 100 has a diameter of 5.69 inches and exit port 101 has a diameter of 5.06 inches. The lengths of the different sections of the combustion chamber are as follows: $L_1$ is 16.17 inches; $L_2$ is 4.15 inches, $L_3$ is 4.31 inches, $L_4$ is 3.40 inches with a combined length of the combustion chamber from inlet port 100 to exit port 101 of 28.03 inches. The angle $\alpha$ is 40°, length R1 is 25.15 inches, length R2 is 6.46 inches, length R3 is 4.31 inches and length R4 is 3.40 inches.

Pulse combustor systems of the present invention regulate their own stoichiometry within their range of firing without need of extensive controls to regulate the fuel feed to combustion air mass flow rate ratio. As the fuel feed rate is increased, the strength of the pressure pulsations in combustion chamber 14 increases, which, in turn, increases the amount of air aspirated by the aerodynamic valve. Thus the combustor automatically maintains a substantially constant stoichiometry over its designed firing range. The induced stoichiometry can be changed by modifying the aerodynamic valve fluidic diodicity.

Figure 3:
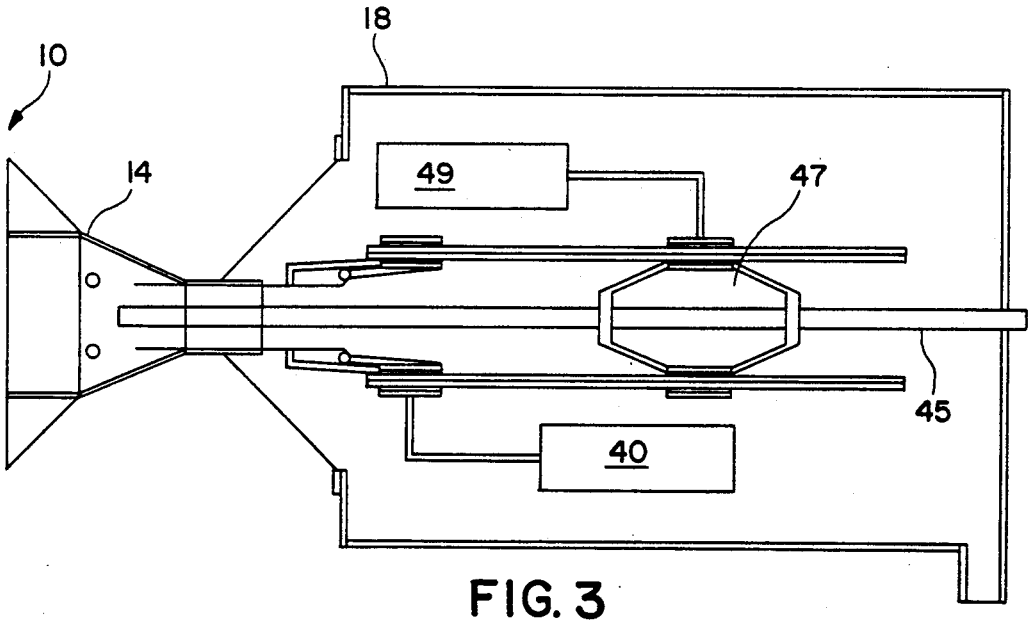
FIG. 3 is a schematic illustration of an embodiment of a valve means for a pulse combustor according to the present invention.

An aerovalve as shown in FIG. 3 may also be employed in the present invention so that the acoustic pressure wave of the pulse combustor is tunable. As schematically illustrated, a stationary sleeve is in communication with combustion chamber 14, with the aerovalve 12 located therein for to and from movement therealong. Valve 12 is in turn connected to a control means such as a linear actuator 40 which imparts desired movement to valve 12. For example, movement of valve 12 modifies the fuel residence time in advance of combustion chamber as well as the stoichiometry. When valve 12 is closer to chamber 14, less residence time is available. Increased residence time permits more fuel-air mixing as well as more devolitilization of the fuel. Likewise, while a fuel-air mixture may be introduced through inlet pipe 45 extending through plenum 18, a sorbent injection site 47 may be employed therealong, with axial adjustment afforded as by a linear actuator 49.

Figure 6A:
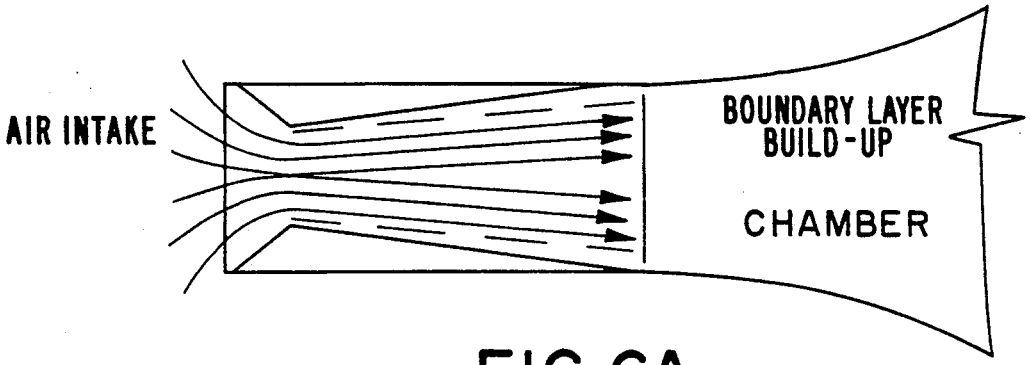
FIGS. 6A and 6B are illustrations of the diodic effect for a diffuser-based aerodynamic valve means according to the present invention.
Figure 6B:
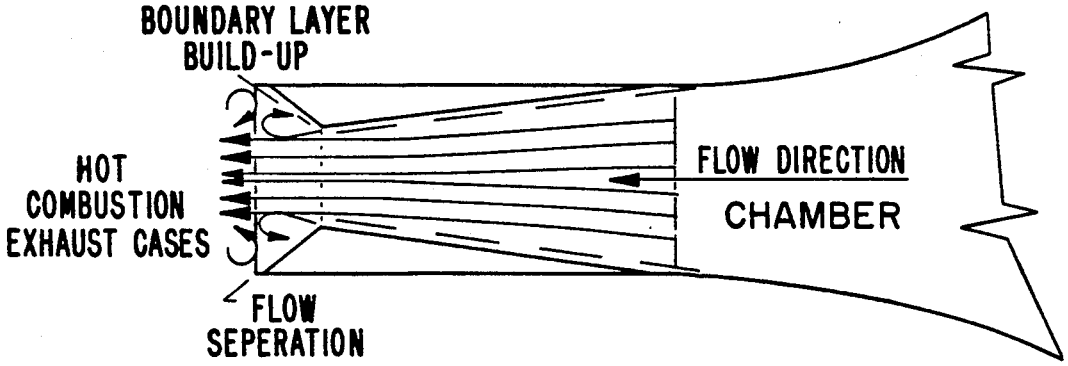

A further illustration of the diodic effect of the chamber's inlet and exit diffusers using the attributes of the diffuser-based aerodynamic valve design is shown in FIGS. 6A and 6B. In this design, two simple, opposite conic diffuser sections comprise the aerodynamic valve. At the inlet, a steep diffuser angle is used which can be between 40° and 60° (half cone angle). On the combustion chamber side, a generous shallow angle diffuser is used to provide for efficient pressure recovery (4° to 7°). The length of the diffuser sections and the minimum aerodynamic valve diameter are selected to meet the combustor integration and performance requirements. Through these variables the overall fluidic diodicity and minimum recharge resistance for a given mean flow rate can be modified.

Air intake flow characteristics are shown in FIG. 6A. The boundary layer build-up, which is monotonic in the direction of the flow, is compensated for by the diverging cross-sectional area of the shallow diffuser section. The intake stream also draws from a large area near the valve intake since there is no flow separation on intake from the steep diffuser because of the flow acceleration from a large to a narrow cross-section.

The exhaust flow characteristics are shown in FIG. 6B. The boundary layer build-up over the length of the shallow angle diffuser in the direction of flow, together with the diffuser angle, cause the effective minimum diameter to be small. Flow is then separated from the steep angle diffuser with reverse flow causing the stream lines to remain within a small cross-sectional are for exhaust.

Both the flow characteristics and differences in temperature between the intake air and the chamber reverse flow gases give rise to the aerodynamic valve fluidic diodicity. With the fluctuating pressure in the chamber, the fluidic diodicity of the aerodynamic valve causes the net flow at the aerodynamic valve to intake combustion air at a self-induced level of stoichiometry.

In certain embodiments of the present invention, two (2) pulse combustors may be arranged in a tandem configuration wherein the combustion chambers and tailpipes constitute a common fire tube (not shown). The tandem operation employs a 180° phase lag between each combustor unit and results in super-positioning of acoustic waves and cancellation of the fugitive sound emissions. A tandem configuration also provides for automatic fuel phasing and super charging. However, the amount of fuel forcibly injected into the pulse combustor during the exhaust phase is reduced in some tandem designs. Such injection may be undesirable since fuel particles are rapidly and prematurely conveyed out of the pulse combustion chamber, thereby resulting in a low combustion efficiency.

Figure 7A:
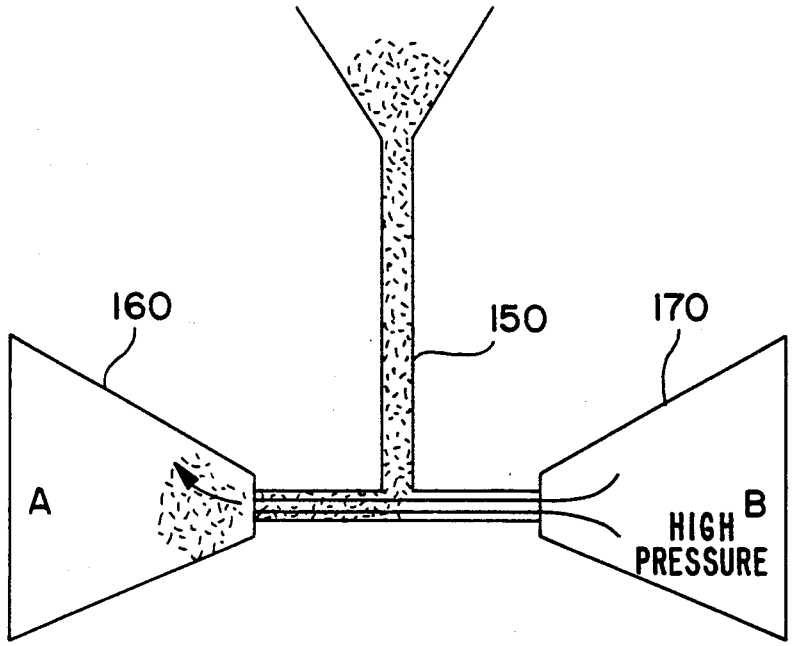
FIGS. 7A and 7B are illustrations of a tandemly configured set of pulse combustors showing a fuel injection means for each pulse combustor.
Figure 7B:
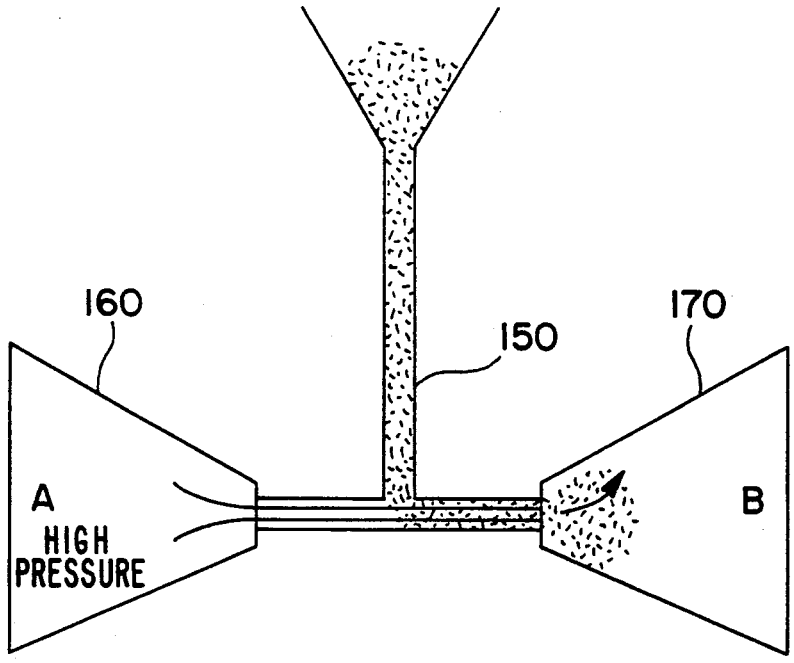

An alternative embodiment utilizing tandem combustors that more effectively reduces injection of fuels during the exhaust phase and is preferred is shown in FIGS. 7A and 7B. In this tandem configuration, fuel feeds along a main fuel line tee 150 with one leg of the tee connected to each of the tandem combustors. Fuel tee 150 acts as a coupling allowing automatic fuel biasing between pulse combustor chambers 160 and 170. Efficient phasing of fuel in fuel tee 150 is effected by the ability to operate tandem pulse combustor chambers 150 and 160 180° out of phase. Under these conditions, one combustion chamber achieves a low pressure phase just as the other chamber simultaneously achieves a high pressure phase. Due to the pressure gradient existing in fuel coupling tee 150, combustion products are accelerated from the high pressure chamber to the low pressure chamber. The momentum of the accelerated gases biases a flow of fuel from the main fuel source into fuel line tee 150 and eventually into the low pressure combustion chamber. A half-cycle later, a similar phenomenon occurs in the opposing direction. By these means, fuel can be properly phased without the use of mechanical flapper valves or an independent phasing chamber. The natural instability of the tandem units employing a common fuel coupling line are sufficient to automatically pull the two combustion units 180° out of phase because the units inherently hunt for the most stable and robust operating state. That state results in efficient fuel phasing, i.e., a 180° phase lag.

Several means for coupling tandem combustion units 150 and 160 exist including tailpipe coupling and aerodynamic valve coupling. Tailpipe coupling is an effective approach due to the super-charging action of the high momentum exhaust fluids which allow unburned particles to be retained within the influence of the intense fluctuating combustion product flow field at the exhaust region for a longer period of time.

Figure 8:
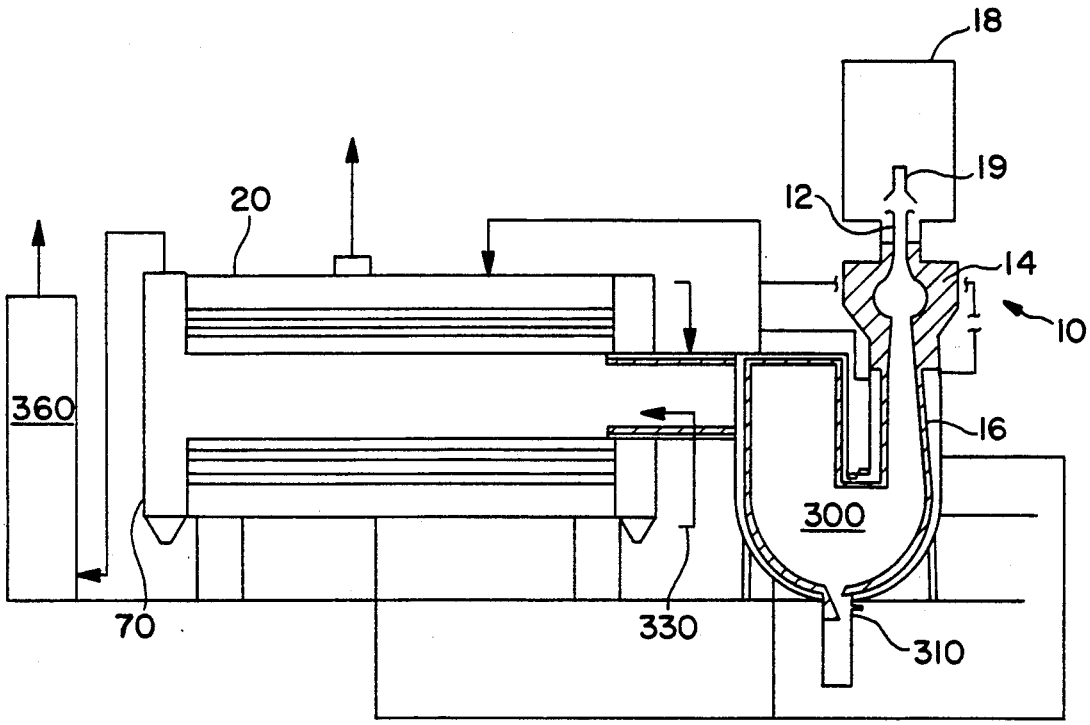
FIG. 8 shows a further embodiment of a pulse combusted fluid heating apparatus according to the present invention.

The apparatus of the present invention may also be designed to run in a slagging mode where the temperature of the system is at least that required to cause the particulates within the gas stream to slag. A design for a slagging combustor according to the present invention is shown in FIG. 8 wherein like numerals represent like members discussed with respect to FIG. 1. A slag tap 310 is kept hot with an auxiliary burner so that slag remains molten and flows into a slag collection vessel without plugging the collection port.

Resonance tube 16 and water-cooled decoupler section 300 are configured in a U-shape in FIG. 8 to accommodate limited space requirements, For slagging operations, a refractory-lined combustion chamber 14 and resonance tube 16 may be required. A slag tap 310 is provided at the bottom of decoupler 300 and may be any type of outlet capable of removing slag from the system. As shown, slag will generally form on the inner walls of resonance tube 16 and decoupler section 300 and drain towards slag tap 310 where it will remain heated for removal in conventional fashion.

FIG. 8 also shows previously-mentioned thrust augmenter 19 in communication with valve means 12 and contained within air plenum 18.

When operated in the slagging mode, means should be provided for introducing sorbent for contaminant capture downstream from pulse combustor means 10. The lower temperatures downstream allow the sorbent to remain in solid form, thus allowing the sorbent to adequately effect sorption of the contaminants. As shown in FIG. 8, such means for introducing the sorbent are shown downstream from decoupler section 300 at inlet 330. The means for introducing the sorbent may include any conventional port for allowing introduction of particles into a pressurized chamber.

In addition to cyclone 70 a scrubber unit 360 is shown for further cleaning of the particulates from the gas stream prior to emitting the gas into the atmosphere.

Figure 9:
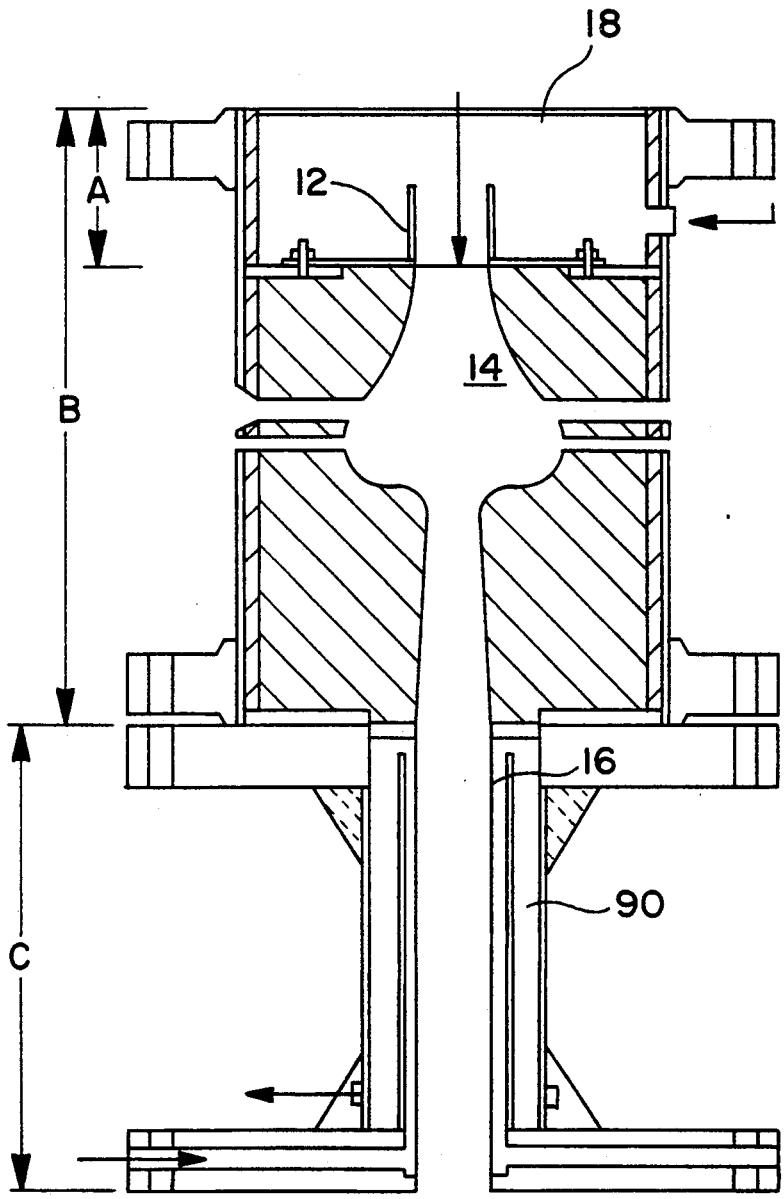
FIG. 9 is a schematic illustration of a further preferred embodiment of a pulse combustor according to the present invention.

Another embodiment of pulse combustor means 10 showing additional features thereof is shown in FIG. 9. Particularly, FIG. 9 shows resonance tube 16 water cooled with a water jacket 90 therearound. In addition, FIG. 9 shows the previously-described configuration of resonance tube 16 wherein resonance tube 16 flares outwardly immediately from combustion chamber 14, but then becomes straight therebeyond. In this embodiment, length A is 14.15 inches, length B is 36.00 inches and length C is 76.67 inches.

Although preferred embodiments of the invention have been described using specific terms, devices, concentrations, and methods, such description is for illustrative purposes only. The words used are words of description rather than of limitation. It is to be understood that changes and variations may be made without departing from the spirit or the scope of the following claims.

What is claimed is:

1. A process for heating a fluid comprising the steps of a) passing a fluid to be heated through a vessel;

b) pulse combusting a fuel to produce a pulsating flow of combustion products and an acoustic pressure wave at a frequency of from about 20 to about 1500 Hz and directly passing said flow of combustion products through said vessel to effectuate heat transfer to said fluid for predetermined heating of said fluid;

c) removing particulate materials from said combustion product flow; and d) forwarding said heated fluid to accomplish its intended function.

2. A process as defined in claim 1 wherein said pulse combustion means operates at a temperature below the slagging point of combustion products of the fuel combusted therein.

3. A process as defined in claim 1 wherein pressure in the vessel in which the fluid is heated is maintained at a level below about 30 psig.

4. A process as defined in claim 1 further comprising the step of introducing into said combustion product flow a particulate material having a size distribution different than particulate material resulting from said pulse combustion to effect bimodal agglomeration of said particulate material.

5. A process as defined in claim 4 wherein said introduced particulate material is also a sorbent for a contaminant in said combustion product flow for sorption of said contaminant.

6. A process as defined in claim 5 wherein said contaminant is a surface product and said particulate material is a sorbent therefor.

7. A process as defined in claim 1 wherein partial removal of agglomerated particulate material is accomplished prior to said combustion product flow exiting said vessel.

8. Apparatus for heating a fluid comprising:

a) a fluid treating vessel, said vessel having means therein for containing a fluid to be heated and fluid inlet and outlet means in communication therewith, said vessel further having means therein for passage of hot gases therethrough to effectuate heat transfer from gas passing through said means to said fluid, said vessel further having outlet means from said gas passage means;

b) pulse combustion means in communication with said hot gas passage means of said fluid treating vessel, said pulse combustion means being capable of combusting a fuel-air mixture to produce a pulsating flow of hot combustion products and an acoustic wave at a frequency in a range of from about 20 to about 1500 Hz, said pulse combustion means including valve means for receiving a fuel-air mixture on demand, a combustion chamber in communication with said valve means and at least one resonance tube in communication with said combustion chamber and said gas passage means of said fluid heating vessel to supply hot gas to said gas passage means, said pulse combustion means being located adjacent said hot gas passage means so that said pulsating flow of hot combustion products supply heat directly to said hot gas passage means, said pulse combustion means being further located at least partially within a portion of said fluid containing means so that heat may be transferred from said pulse combustion means to fluid in said portion of said fluid containing means;

c) means located along an initial portion of said hot gas passage means for partial removal of particulate from said gas passing therethrough; and d) further means for removal of particulate material from said gas located upstream of said fluid heating vessel for substantial removal of remaining particulate material from said gas.

9. Apparatus as defined in claim 8 wherein said pulse combustion means is quadratic.

10. Apparatus as defined in claim 8 wherein said pulse combustion means is tunable.

11. Apparatus as defined in claim 8 wherein said apparatus operates at low pressure.

12. Apparatus as defined in claim 8 wherein said fluid heating vessel is a fire tube boiler.

13. Apparatus as defined in claim 8 wherein said combustion chamber and at least one resonance tube of said pulse combustion means are jacketed for water cooling.

14. Apparatus as defined in claim 8 wherein said hot gas passage means is at least one tube that extends throughout said vessel and is serpentine in shape, making a plurality of passes therethrough, and wherein said partial particulate removal means is located therealong at a location before said tube reverses its path in said vessel.

15. Apparatus as defined in claim 8 wherein said further particulate removal means is a cyclone.

16. Apparatus for heating a fluid comprising:

a) a fluid treating vessel, said vessel having means therein for containing a fluid to be heated and fluid inlet and outlet means in communication therewith, said vessel further having means therein for passage of a hot gas stream therethrough to effectuate heat transfer from gas passing through said means to said fluid, said vessel further having outlet means from said gas passage means;

b) tunable pulse combustion means connected to said fluid heating vessel, said pulse combustion means including an adjustable fuel valve means for admission of fuel to said pulse combustion means on demand, a combustion chamber in communication with said fuel valve means and a plurality of resonance tubes in communication with said combustion chamber and said hot gas passage means of said vessel, said pulse combustion means being located adjacent said fluid heating vessel to provide heat from said pulse combustion means directly to said gas passage means, said pulse combustion means being further located at least partially within a portion of said fluid containing means so that heat may be transferred from said pulse combustion means to fluid in said portion of said fluid containing means; and c) means for removing particulate material from said gas stream.

17. Apparatus as defined in claim 16 wherein said fuel valve means of said pulse combustion means is adjustable to and from with respect to said combustion chamber.

18. Apparatus as defined in claim 16 wherein said pulse combustion means is quadratic.

19. Apparatus as defined in claim 16 wherein said gas passage means comprises a tube in serpentine arrangement within said vessel.

20. Apparatus as defined in claim 19 further comprising partial particulate material removal means located along a first pass of said tube.

* * * * *